US007450883B2

(12) United States Patent
Asaoka et al.

(10) Patent No.: US 7,450,883 B2
(45) Date of Patent: Nov. 11, 2008

(54) FILM LOADER FOR AN IMAGE FORMING APPARATUS

(75) Inventors: Akira Asaoka, Ibaraki (JP); Shuho Yokokawa, Ibaraki (JP); Isao Nakajima, Ibaraki (JP); Akihiko Yamazaki, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 0 days.

(21) Appl. No.: 12/005,306

(22) Filed: Dec. 27, 2007

(65) Prior Publication Data

US 2008/0118269 A1 May 22, 2008

Related U.S. Application Data

(63) Continuation of application No. 10/448,293, filed on May 30, 2003, now Pat. No. 7,336,917.

(30) Foreign Application Priority Data

Jun. 14, 2002 (JP) ..... P2002-174037

(51) Int. Cl.
*G03G 15/00* (2006.01)

(52) U.S. Cl. ..... 399/116

(58) Field of Classification Search ..... 399/116, 399/117, 162

See application file for complete search history.

(56) References Cited

U.S. PATENT DOCUMENTS

| | | | | |
|---|---|---|---|---|
| 4,766,455 | A | 8/1988 | Carter | |
| 4,811,839 | A | 3/1989 | Cornell et al. | |
| 5,417,322 | A | 5/1995 | Jeran et al. | |
| 5,708,924 | A | 1/1998 | Shogren et al. | |
| 6,049,682 | A * | 4/2000 | Goetzke et al. | 399/116 |
| 6,097,912 | A | 8/2000 | Watson et al. | |
| 6,175,704 | B1 | 1/2001 | Yamamoto | |
| 6,233,415 | B1 | 5/2001 | Pang | |

(Continued)

FOREIGN PATENT DOCUMENTS

| | | |
|---|---|---|
| JP | 63-29242 | 2/1988 |

(Continued)

OTHER PUBLICATIONS

Japanese Office Action dated May 25, 2007 with English Translation.

*Primary Examiner*—Quana M Grainger
(74) *Attorney, Agent, or Firm*—McGinn Ip Law Group, PLLC

(57) ABSTRACT

A film loading method of an image forming apparatus, includes: loading an endless film which was stored in a container box, using at least two support members, to a film frame of the image forming apparatus, wherein the film is supported by the support members in a different form with respect to a condition of the film when loaded and fitted to the film frame. The support members are initially stored in the container box and serve as a packaging member for use in transporting and storing the film. The support members are attached to respective portions of the film frame and guide the film to be loaded and fitted onto the film frame. The film frame includes holding rollers, and the support members are attached to the respective portions of the film frame, coaxially with the holding rollers.

21 Claims, 6 Drawing Sheets

U.S. PATENT DOCUMENTS

| | | | |
|---|---|---|---|
| 6,356,725 | B1 | 3/2002 | Park et al. |
| 6,393,236 | B1 | 5/2002 | Yamamoto |
| 6,459,871 | B2 | 10/2002 | Kwak et al. |

FOREIGN PATENT DOCUMENTS

| | | |
|---|---|---|
| JP | 1-133163 | 9/1989 |
| JP | 05-213472 | 8/1993 |
| JP | 10-143045 | 5/1998 |
| JP | 2002-040902 | 2/2002 |

* cited by examiner

FILM LOADER FOR AN IMAGE FORMING APPARATUS

The present application is a Continuation of U.S. application Ser. No. 10/448,293, filed on May 30, 2003 now U.S. Pat. No. 7,336,917.

BACKGROUND OF THE INVENTION

1. Field of the Invention

The present invention relates to a film loader for an image forming apparatus, and more particularly to the loading of a film such as a photosensitive film, an intermediate transfer film, a transfer film, a carrier film or a fixing film to be used in each portion of an electrophotographic printer.

2. Description of the Related Art

A conventional film loading method includes steps of detaching a film frame from a main body of an image forming apparatus, placing the film frame vertically, loading a photosensitive film into the film frame longitudinally from above, and thereafter attaching the film frame to the main body of the image forming apparatus.

FIG. 12 is a schematic view of the film loader with a photosensitive film loaded in the related art. In FIG. 12, reference numeral 1 denotes the photosensitive film, reference numeral 5 denotes the film frame, and reference numerals 6*a* and 6*b* denote holding rollers for holding the photosensitive film 1. In loading the photosensitive film 1, while the photosensitive film 1 is supported by an operator's hand in a state where the film frame 5 is drawn horizontally from the main body not shown, the photosensitive film 1 is aligned with the film frame 5 and the holding rollers 6*a* and 6*b* and then loaded into the film frame 5.

In this operation, the operator conducts the replacement of the photosensitive film while the operator touches only an inner backing portion of the film or end portions of the film surface (both of annular edge portions), but does not touch the surface of the photosensitive film or wears globes.

In the related art where the film frame is vertically placed, it is necessary to detach the film frame from the main body of the image forming apparatus. The film frame is a heavy substance, and there arises problems in the respects of operability and maintenance.

Also, in the related art where the photosensitive film is loaded into the film frame horizontally drawn from the main body of the apparatus by an operator's hand, it is impossible to repair a slack in the central part of the film when loading, causing a bend or a crack in the photosensitive film, resulting in a problem that the photosensitive film is damaged on the surface and unusable.

Particularly, the latest image forming apparatus with very high processing speed has a peripheral length of the photosensitive film of 2 m or more, and a length in the depth direction (drawing direction in loading) of 60 cm or more, whereby some skills are required to load the film into the film load because two operators are difficult to load the film thereinto.

SUMMARY OF THE INVENTION

The present invention has been made in view of the above circumstances, and therefore an object of the invention is to provide a film loader for an image forming apparatus which makes it possible to readily load a film without damaging the film surface.

To achieve the above object, according to one aspect of this invention, there is provided a film loading method of an image forming apparatus, the method including: loading an endless film which was stored in a container box, using at least two support members, to a film frame of the image forming apparatus, wherein the film is supported by the support members in a different form with respect to a condition of the film when loaded and fitted to the film frame, wherein the support members are initially stored in the container box and serve as a packaging member for use in transporting and storing the film, wherein the support members are attached to respective portions of the film frame and guide the film to be loaded and fitted onto the film frame, wherein the film frame comprises holding rollers, and wherein the support members are attached to the respective portions of the film frame, coaxially with the holding rollers.

The different form may include a free form of the film being supported by the support members.

The different form may include an untensioned form of the film being supported by the support members.

The different form may include a loosened form of the film being supported by the support members.

The different form may include a flexible form of the film being supported by the support members.

The different form may include a loosely slackened form of the film being supported by the support members.

The different form may include a relaxed form of the film being supported by the support members.

According to another aspect of this invention, there is a film loading method of an image forming apparatus, the method including: preparing a film package that may include a container box in which at least two support members and an endless film are stored; taking out the film and the support members from the container box; attaching the support members to a film frame of the image forming apparatus; and loading the film on the film frame by moving the endless film from the support members onto the film frame, wherein, when preparing the film package, the support members serve as a packaging member for use in transporting and storing the film, wherein, when attaching the support members, the film is supported by the support members in a different form with respect to a condition of the film when loaded and fitted to the film frame of the image forming apparatus, wherein the at least two support members are attached to respective portions of the film frame and guide the film to be loaded and fitted onto the film frame, wherein the film frame may include holding rollers, and wherein the support members are attached to the respective portions of the film frame, coaxially with the holding rollers.

The different form may include a free form of the film being supported by the support members.

The different form may include an untensioned form of the film being supported by the support members.

The different form may include a loosened form of the film being supported by the support members.

The different form may include a flexible form of the film being supported by the support members.

The different form may include a loosely slackened form of the film being supported by the support members.

The different form may include a relaxed form of the film being supported by the support members.

According to another aspect of this invention, there is provided an image forming apparatus having a film frame for holding an endless film, and adapting to a film package including the film stored in a container box, including: the film frame includes attaching portions on which at least two support members, which support the film in a different form with respect to a condition of the film when loaded and fitted to the film frame, and which serve as a packaging member for use in transporting and storing the film, are attached, wherein the film frame may include holding rollers, and wherein the support members are attached to the attaching portions, coaxially with the holding rollers.

The different form may include a free form of the film being supported by the support members.

The different form may include an untensioned form of the film being supported by the support members.

The different form may include a loosened form of the film being supported by the support members.

The different form may include a flexible form of the film being supported by the support members.

The different form may include a loosely slackened form of the film being supported by the support members.

The different form may include a relaxed form of the film being supported by the support members.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Now, a description will be given in more detail of preferred embodiments of the invention with reference to the accompanying drawings.

In the following description, a photosensitive film is employed, but the invention is not limited to thereto, and the invention may be applied to an intermediate transfer body, a transfer film, a carrier film and a fixing film besides the photosensitive film.

First Embodiment

Figure 1:
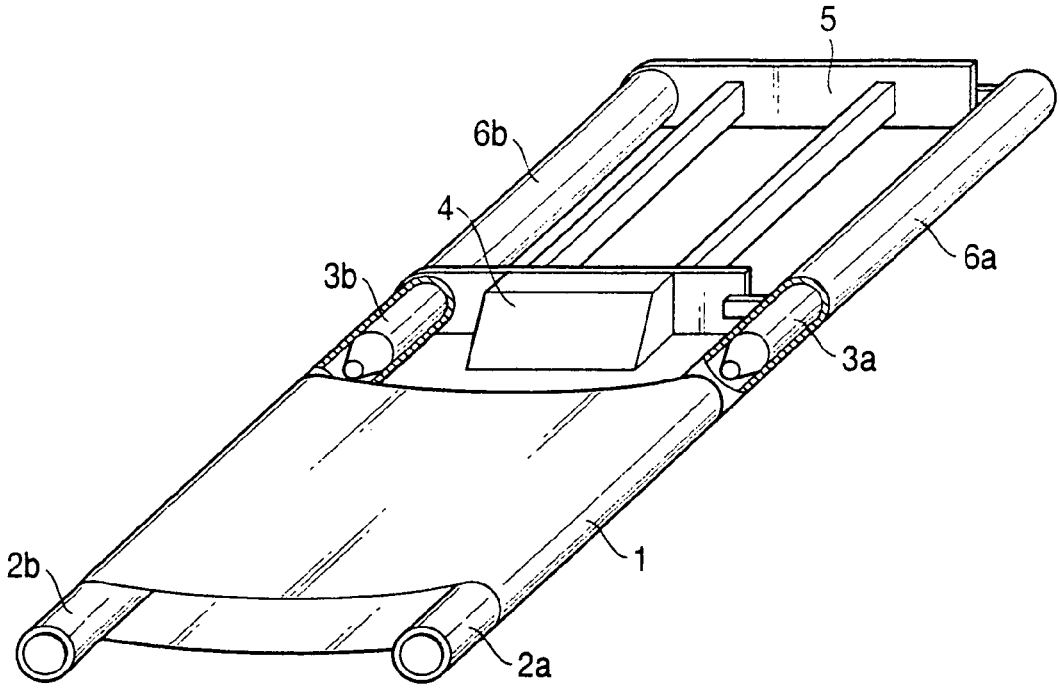
FIG. 1 is a schematic view of a film loader with a photosensitive film loaded-according to the present invention.

FIG. 1 is a schematic view of a film loader for an image forming apparatus according to an embodiment of the invention. In FIG. 1, reference numeral 1 denotes a photosensitive film, 2*a* and 2*b* are pipes, 3*a* and 3*b* are adaptors, 4 is a guide member, 5 is a film frame, and 6*a* and 6*b* are holding rollers.

In loading the photosensitive film 1, the film frame 5 is drawn horizontally from a main body of the apparatus not shown, the adaptors 3*a*, 3*b* and the guide member 4 are attached to the film frame 5 as shown in FIG. 1, and thereafter the pipes 2*a* and 2*b* around which the photosensitive film 1 is put are fitted to the adaptors 3*a* and 3*b*, thereby supporting the photosensitive film 1. The guide member 4 is tapered such that when an operator loads the film loader with the photosensitive film 1, a slack occurring in the center of the photosensitive film 1 is eliminated along the taper of the guide member 4. Also, because the photosensitive film 1 is supported by the pipes 2*a* and 2*b*, the photosensitive film 1 can be prevented from dropping down. Accordingly, the photosensitive film 1 can be readily loaded into the film loader without damaging the surface of the photosensitive film 1. In this case, the pipes 2*a* and 2*b* must be securely fitted to the adaptors 3*a* and 3*b*, and the adaptors 3*a* and 3*b* must be securely fitted to the film frame 5, respectively, as shown in FIG. 2.

Figure 2:
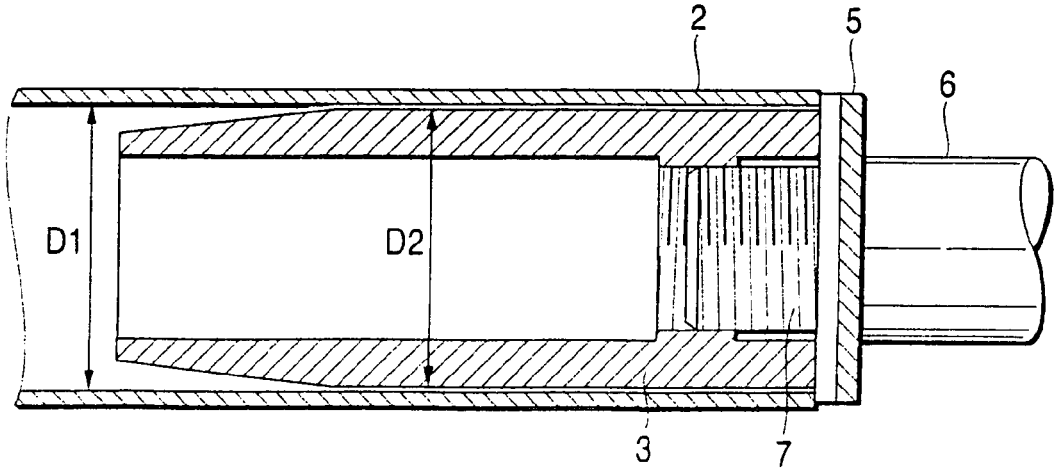
FIG. 2 is a cross-sectional view of an attaching portion between a guide plate and a film plate according to the embodiment of this invention.

In FIG. 2, reference numeral 2 denotes a pipe, reference numeral 3 denotes an adaptor, reference numeral 5 denotes a film frame, reference numeral 6 denotes a support roller, and reference numeral 7 denotes a flange. The flange 7 is so designed as to rotatably fit the support roller 6 to the film frame 5. The adaptor 3 and the flange 7 are screwed such that they can be securely fixed to each other so as to prevent the adaptor 3 from dropping down.

A leading end portion of the adaptor 3 is tapered so that the pipe 2 can be readily inserted into the adaptor 3. The dimensional relation between an inner diameter D1 of the pipe 2 and an outer diameter D2 of the adaptor 3 is placed in clearance fit, and because the outer diameter D2 of the adaptor 3 ensures a length sufficient to fit the pipe 2 substantially horizontally, the pipe 2 can be surely fitted into the adaptor 3.

Figure 3:
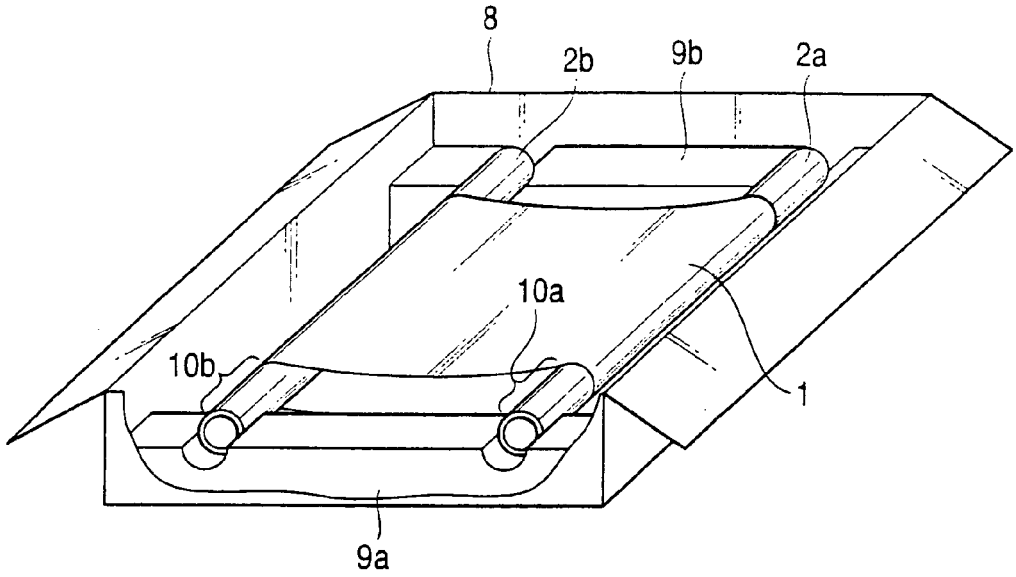
FIG. 3 is a schematic view of the film loader with the photosensitive film packaged according to another embodiment of the invention.

The pipes 2*a* and 2*b* in FIG. 1 are package members used for transport and storage of the photosensitive film as shown in FIG. 3. The pipes 2*a* and 2*b* as the package members are made of, for example, paper, resin or metal such as aluminum. Paper is superior from the viewpoints of low costs, lightweight and disposal. Also, resin is superior from the viewpoints of lightweight and high strength, and metal such as aluminum is superior from the viewpoint of high strength. Among those materials, paper pipes are most preferable to this invention.

Referring to FIG. 3, reference 1 denotes a photosensitive film, 2*a* and 2 are pipes, 8 is a container box, and 9*a* and 9*b* are pipe fixing members. The photosensitive film 1 is supported by the pipes 2*a* and 2*b*, and then fixed on the pipe fixing members 9*a* and 9*b* in such a manner that the surfaces of the photosensitive film 1 are completely out of contact with the interior of the container box 8.

In taking out the photosensitive film 1 from the container box 8, an operator holds end portions 10*a* and 10*b* of the pipes 2*a* and 2*b*, and then takes out the photosensitive film 1 and the pipes 2*a* and 2*b* together. This makes it unnecessary that the operator touches the surface of the photosensitive film 1 with his hand. As a result, the operator can take out the photosensitive film 1 from the container box 8 without damaging the surface of the photosensitive film 1.

Figure 11:
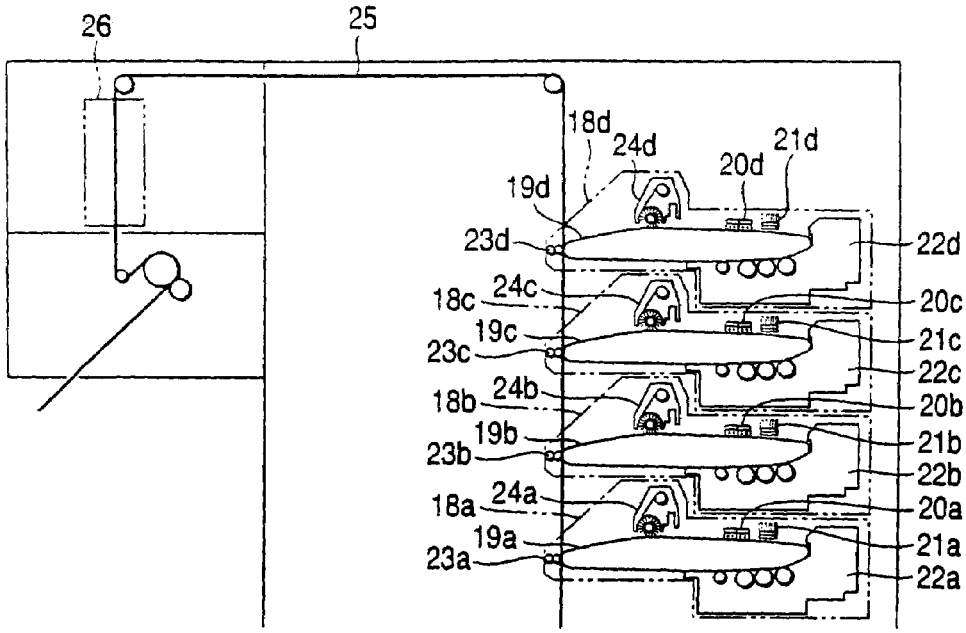
FIG. 11 is a schematic view of an image forming apparatus to which the invention is applied.
Figure 12:
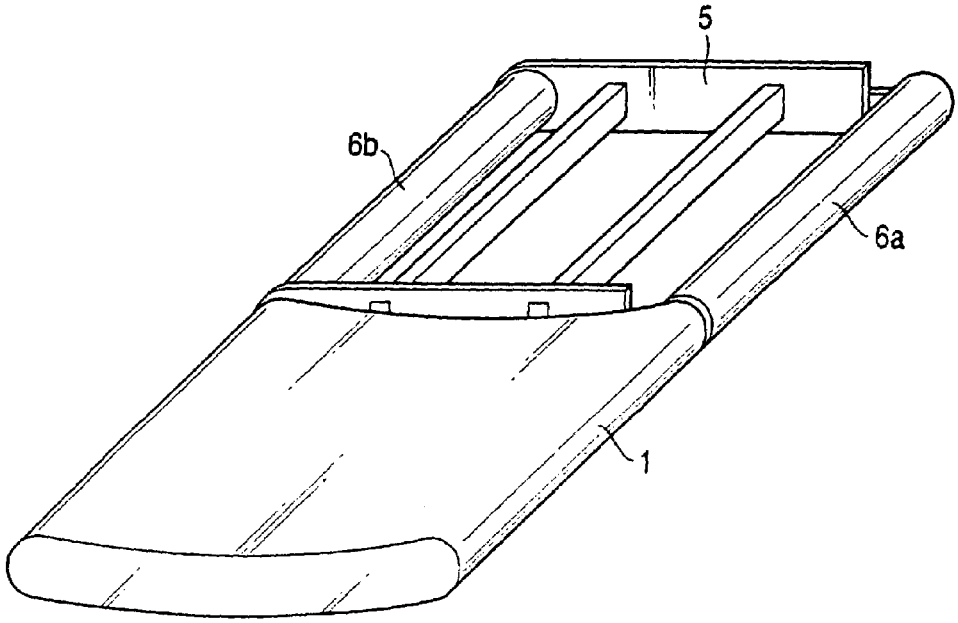
FIG. 12 PRIOR ART
FIG. 12 is a schematic view of a conventional film loader with a photosensitive film loaded.

Referring to FIG. 11, the overall constitution of the above-mentioned image forming apparatus with the photosensitive film loaded will be described below.

A printing unit 18*a* includes a photosensitive film 19*a*, an electrifier 20*a*, an exposing unit 21*a*, a developing unit 22*a*, a transfer unit 23*a*, and a cleaner 24*a*. Printing units 18*b* to 18*d* are identical in construction with the printing unit 18*a*.

The printing units 18*a* to 18*d* make the printing of different colors on a sheet 25, for example, the printing unit 18*a* for yellow, the printing unit 18*b* for magenta, the printing unit 18*c* for cyan, and the printing unit 18*d* for black.

The printing operation of the printing unit 18*a* will be described below. The photosensitive film 19*a* starts to rotate on the basis of a printing operation start signal from a controller not shown, rotates at a rate corresponding to a print speed, and continues to rotate until the printing operation is completed. Upon starting to rotate the photosensitive film 19*a*, a high voltage is applied to the electrifier 20*a* so that the surface of the photosensitive film 19*a* is evenly electrified with positive charges.

The character data or graphic data converted into dot images is sent from the controller not shown to the image forming apparatus with an on/off signal of the exposing unit 21*a*, thereby forming an irradiated portion and a non-irradiated portion by the laser beam on the surface of the photosensitive film 19*a* by the exposing unit 21*a*. A portion where charges disappear on the photosensitive film 19*a* comes to a position opposed to the developing unit 22*a* by irradiation of the laser beam from the exposing unit 21*a*, the toner electrified with positive charges is absorbed by static electricity to form a toner image on the photosensitive film 19*a*.

The sheet 25 is conveyed in synchronism with a timing when the print data formed on the photosensitive film 19*a* reaches a transfer position. The toner image formed on the photosensitive film 16*a* is sucked onto the sheet 25 due to an action of the transfer unit 23*a* that attaches charges of reverse polarity to the toner image onto the back side of the sheet 25. The photosensitive film 19*a* that has passed through the transfer position is cleaned by the cleaner 24*a*, and a residual toner on the photosensitive film 19*a* is absorbed by a suction blower not shown, and recovered into a recovery unit not shown, to prepare for the next printing operation.

The sheet 25 having passed through the printing unit 18*a* is subjected to the same printing operation in the printing units 18*b*, 18*c* and 18*d*, and conveyed to the fixing unit 26. The toner image on the sheet 25 that has reached the fixing unit 26 is molten and fixed on the sheet 25.

The photosensitive films 19*a*, 19*b*, 19*c* and 19*d* are deteriorated by repeating the printing operation and therefore must be exchanged periodically.

Thus, using the film loader of the invention, the photosensitive film is easily loaded without detaching the film frame from the main body of the image forming apparatus and without damaging the surface of the photosensitive film by the operator. As a result, it is unnecessary to make an operation of removing the film frame every time the photosensitive film is exchanged, and it is possible to avoid damaging the surface of the photosensitive film before starting the printing operation to make the photosensitive film unusable.

Second Embodiment

Figure 4:
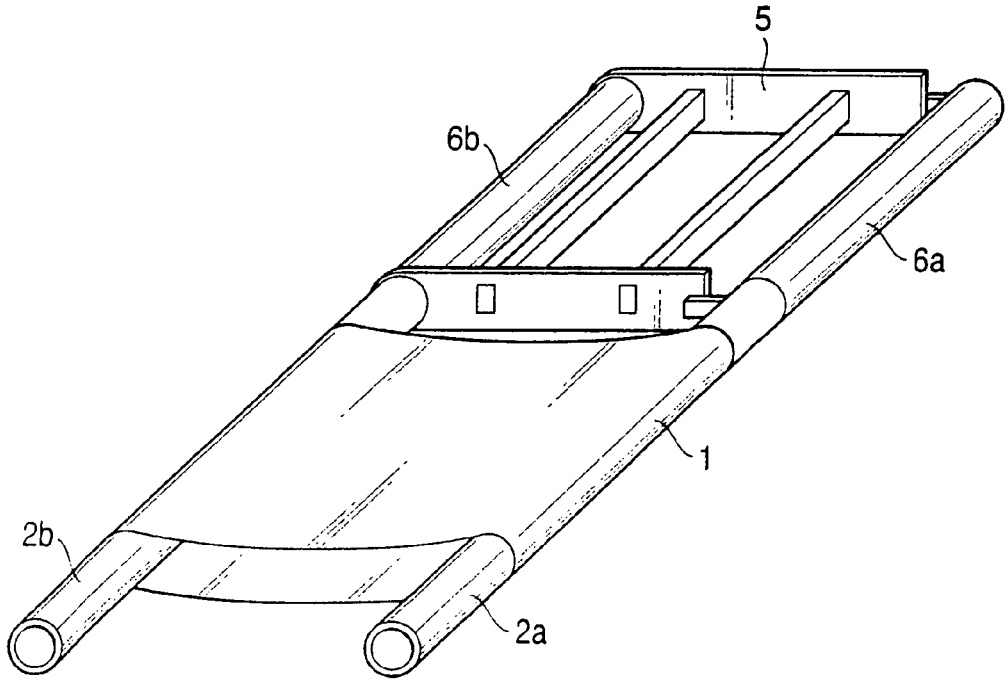
FIG. 4 is a schematic view of a film loader according to another embodiment of the invention.

FIG. 4 is a schematic view showing another embodiment of the invention.

In FIG. 4, in loading the photosensitive film 1, the film frame 5 is drawn horizontally from the main body of the apparatus, the photosensitive film 1 is put around the pipes 2*a* and 2*b*, and the pipes 2*a* and 2*b* are fitted on the film frame 5, thereby supporting the photosensitive film 1. As a result, the operator can correct a slack in the central portion of the photosensitive film 1 by his hand to load the photosensitive film 1 without damaging the surface of the photosensitive film 1.

Figure 5:
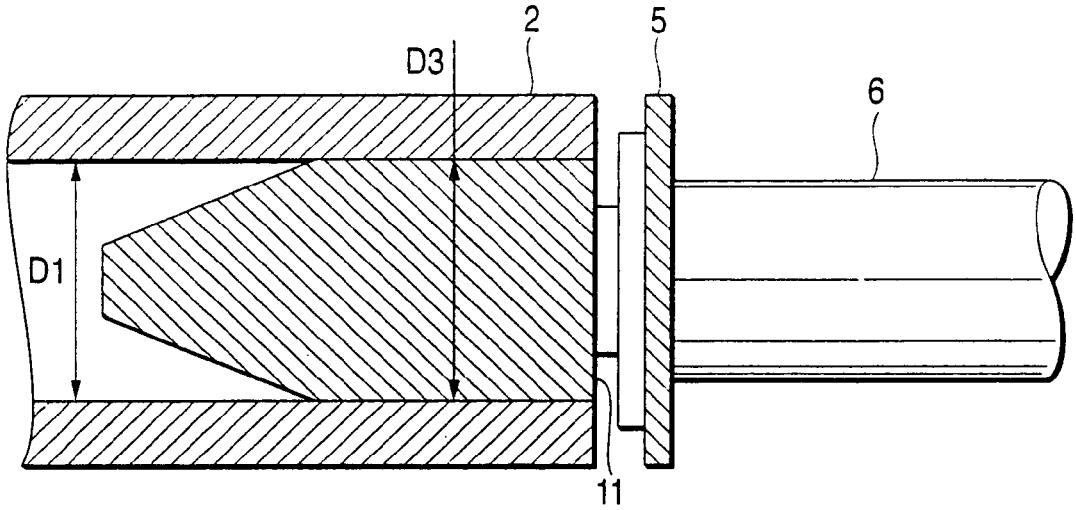
FIG. 5 is a cross-sectional view of an attaching portion between the guide plate and the film plate according to this invention.

The pipes 2*a* and 2*b* are fitted on the film frame 5, for example, with the construction shown in FIG. 5. A leading end portion of the flange 11 disposed on the film frame 5 is tapered so as to readily insert the pipe 2. Also, the dimensional relation between the inner diameter D1 of the pipe 2 and the outer diameter D3 of the flange 11 is placed in tight fit/close fit, thereby making it possible to firmly fit the pipe 2 to the flange.

Figure 6:
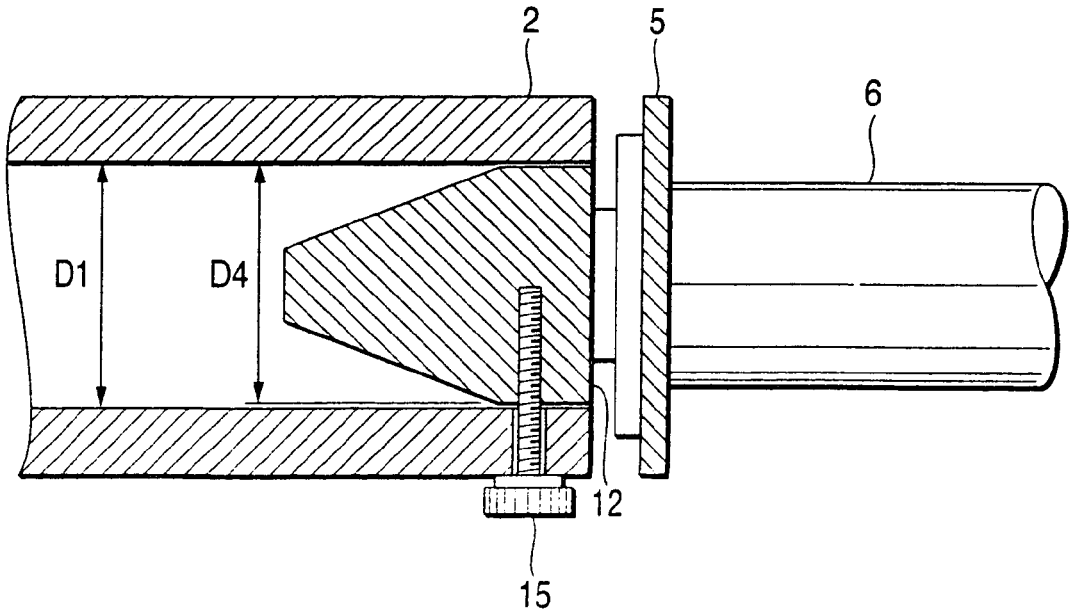
FIG. 6 is a cross-sectional view of an attaching portion between the guide plate and the film plate according to this invention.

Alternatively, the construction shown in FIG. 5 may be replaced by a construction of FIG. 6. In FIG. 6, reference numeral 2 denotes a pipe, 5 is a film frame, 6 is a support roller, 12 is a flange, and 13 is a fixing screw.

The flange 12 has a leading end portion tapered as in the case shown in FIG. 5 so that the pipe 2 can be readily inserted into the flange 12. Also, the dimensional relation between the inner diameter D1 of the pipe 2 and the outer diameter D4 of the flange 14 is placed in clearance fit, thereby making it possible to firmly fit the pipe 2 to the flange with the screw 13 after the pipe 2 has been inserted into the flange 12.

Third Embodiment

Still another embodiment of this invention will be described below.

The constitution of this embodiment is fundamentally the same as shown in FIGS. 4 to 6, but has a feature that a packaging member for use in transporting or storing the film is directly employed as the pipe 2 that is the guide member as shown in FIG. 3. As in the case of FIG. 4, the operator corrects a slack in the central portion of the photosensitive film 1 by his hand to load the photosensitive film 1 without damaging the surface of the photosensitive film 1.

Fourth Embodiment

Figure 7:
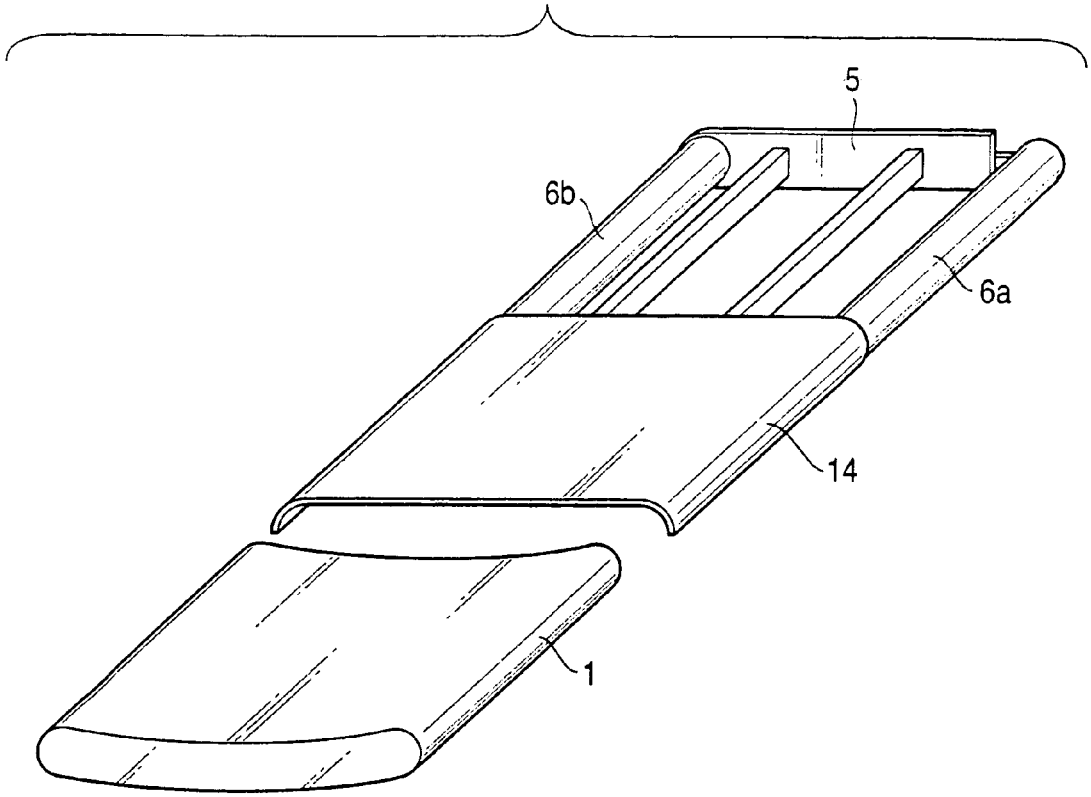
FIG. 7 is a schematic view of a film loader according to another embodiment of the invention.

FIG. 7 is a schematic view showing the structure of a film loader in an image forming apparatus according to still another embodiment of this invention.

In FIG. 7, reference numeral 1 denotes a photosensitive film, 5 is a film frame, 6*a* and 6*b* are support rollers, and 14 is a guide plate.

This embodiment shows an example where the work of attaching or detaching the photosensitive film with respect to the film frame after the photosensitive film is removed from the packaging member (for example, a paper pipe) is conducted.

In loading the photosensitive film 1, the film frame 5 is horizontally drawn out from the main body of the image forming apparatus not shown, the guide plate 14 is fitted onto the film frame 5 as shown in FIG. 7, and thereafter the photosensitive film 1 is loaded into the film frame 5 to support the photosensitive film 1. As a result, the operator can correct a slack in the central portion of the photosensitive film 1 by his hand to load the photosensitive film 1 without damaging the surface of the photosensitive film 1. In this situation, the guide plate 14 must be surely fitted to the film frame 5. A cross-sectional view of the fitting portion is shown in FIG. 8.

Figure 8:
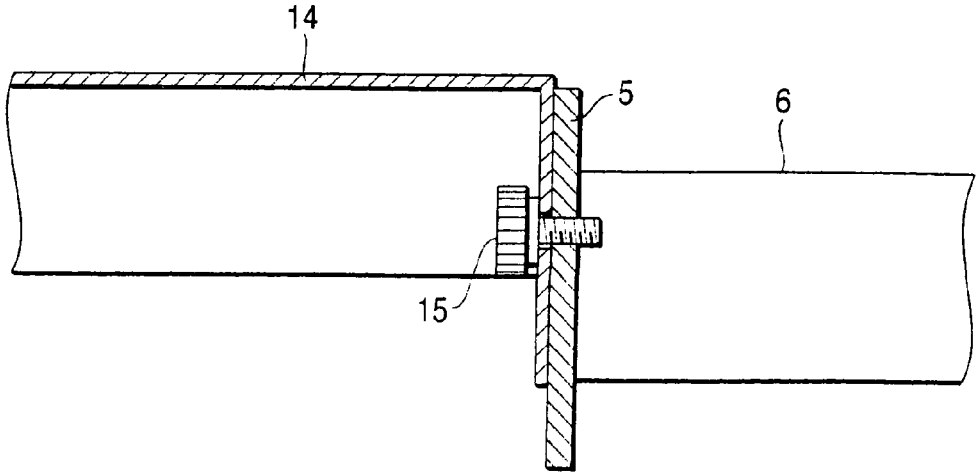
FIG. 8 is a cross-sectional view of an attaching portion between the guide plate and the film plate according to this invention.

In FIG. 8, reference numeral 5 denotes a photosensitive film, 6 is a support roller, 14 is a guide plate, and 15 is a fixing screw. The guide plate 14 is firmly fixed to the film frame 5 with the screw 15.

Figure 9:
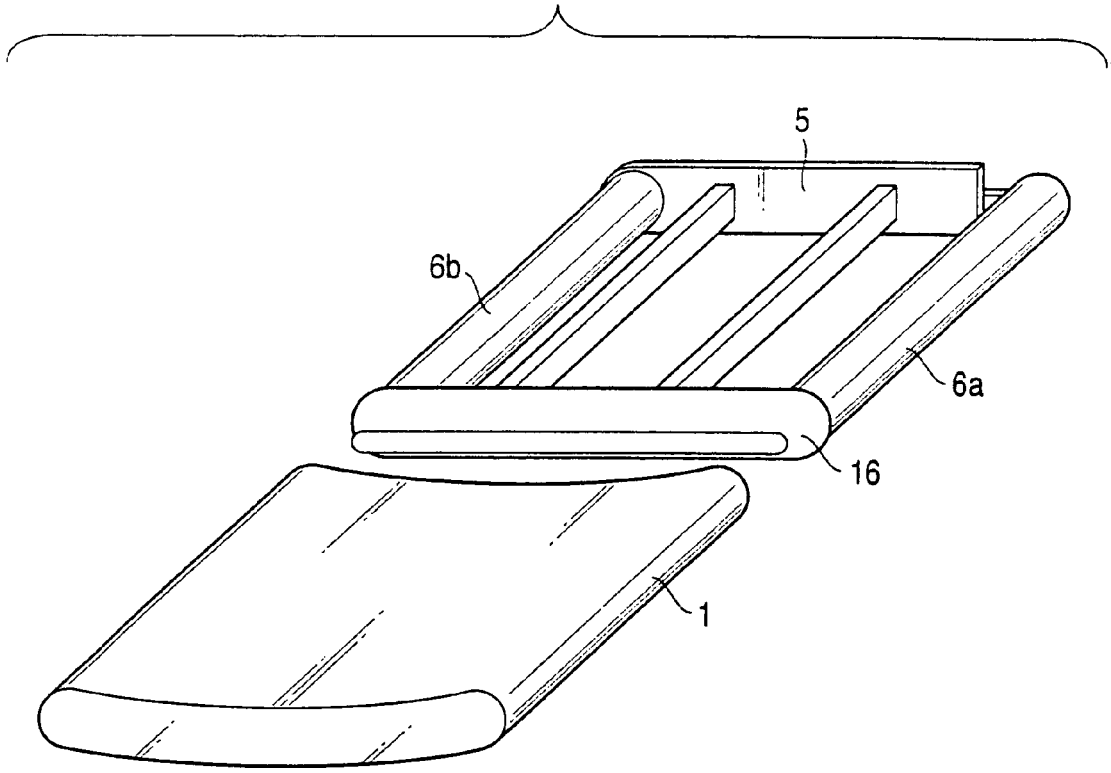
FIG. 9 is a schematic view of a film loader according to another embodiment of the invention.

FIG. 9 is a schematic view showing the structure of a film loader according to still another embodiment of this embodiment. The construction of the guide member is different from that in the above-mentioned embodiment shown in FIGS. 7 and 8.

Figure 10:
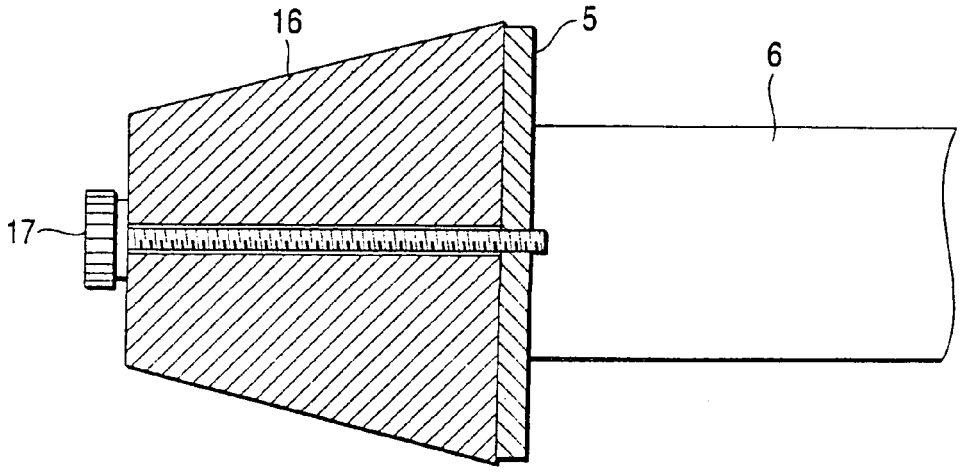
FIG. 10 is a cross-sectional view of an attaching portion between the guide plate and the film plate according to this invention.

In this example, in loading the photosensitive film 1, the film frame 5 is horizontally drawn out from the main body of the apparatus not shown, and the guide 16 is then fitted onto the film frame 5 as shown in FIG. 9. The guide l6 is tapered, and a slack in the central portion of the photosensitive film 1 is eliminated along the tapered portion of the guide when the operator loads the photosensitive film 1 by his hand, thereby loading the photosensitive film 1 without damaging the surface of the photosensitive film 1. In FIG. 10, reference numeral 17 denotes a fixing screw for fixing the guide 16 to the film frame 5.

As was described above, according to this invention, there. can be provided the film loader for the image forming apparatus in which the film can be easily loaded without damaging the film surface.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A film loading method of an image forming apparatus, the method comprising:

loading an endless film which was stored in a container box, using at least two support members, to a film frame of said image forming apparatus, wherein said film is supported by said support members in a different form with respect to a condition of said film when loaded and fitted to said film frame, wherein said support members are initially stored in said container box and serve as a packaging member for use in transporting and storing said film, wherein said support members are attached to respective portions of said film frame and guide said film to be loaded and fitted onto said film frame, wherein said film frame comprises holding rollers, and wherein said support members are attached to said respective portions of said film frame, coaxially with said holding rollers.

2. The method of claim 1, wherein said different form comprises a free form of said film being supported by said support members.

3. The method of claim 1, wherein said different form comprises an untensioned form of said film being supported by said support members.

4. The method of claim 1, wherein said different form comprises a loosened form of said film being supported by said support members.

5. The method of claim 1, wherein said different form comprises a flexible form of said film being supported by said support members.

6. The method of claim 1, wherein said different form comprises a loosely slackened form of said film being supported by said support members.

7. The method of claim 1, wherein said different form comprises a relaxed form of said film being supported by said support members.

8. A film loading method of an image forming apparatus, the method comprising:

preparing a film package that comprises a container box in which at least two support members and an endless film are stored;

taking out said film and said support members from said container box;

attaching said support members to a film frame of said image forming apparatus; and loading said film on said film frame by moving said endless film from said support members onto said film frame, wherein, when preparing said film package, said support members serve as a packaging member for use in transporting and storing said film, wherein, when attaching said support members, said film is supported by said support members in a different form with respect to a condition of said film when loaded and fitted to said film frame of said image forming apparatus, wherein said at least two support members are attached to respective portions of said film frame and guide said film to be loaded and fitted onto said film frame, wherein said film frame comprises holding rollers, and wherein said support members are attached to said respective portions of said film frame, coaxially with said holding rollers.

9. The method of claim 8, wherein said different form comprises a free form of said film being supported by said support members.

10. The method of claim 8, wherein said different form comprises an untensioned form of said film being supported by said support members.

11. The method of claim 8, wherein said different form comprises a loosened form of said film being supported by said support members.

12. The method of claim 8, wherein said different form comprises a flexible form of said film being supported by said support members.

13. The method of claim 3, wherein said different form comprises a loosely slackened form of said film being supported by said support members.

14. The method of claim 8, wherein said different form comprises a related form of said film being supported by said support members.

15. An image forming apparatus having a film frame for holding an endless film, and adapting to a film package including said film stored in a container box, comprising:

said film frame comprises attaching portions on which at least two support members, which support said film in a different form with respect to a condition of said film when loaded and fitted to said film frame, and which serve as a packaging member for use in transporting and storing said film, are attached, wherein said film frame comprises holding rollers, and wherein said support members are attached to said attaching portions, coaxially with said holding rollers.

16. The image forming apparatus of claim 15, wherein said different form comprises a free form of said film being supported by said support members.

17. The image forming apparatus of claim 15, wherein said different form comprises an untensioned form of said film being supported by said support members.

18. The image forming apparatus of claim 15, wherein said different form comprises a loosened form of said film being supported by said support members.

19. The image forming apparatus of claim 15, wherein said different form comprises a flexible form of said film being supported by said support members.

20. The image forming apparatus of claim 15, wherein said different form comprises a loosely slackened form of said film being supported by said support members.

21. The image forming apparatus of claim 15, wherein said different form comprises a related form of said film being supported by said support members.

* * * * *

UNITED STATES PATENT AND TRADEMARK OFFICE

CERTIFICATE OF CORRECTION

PATENT NO. : 7,450,883 B2
APPLICATION NO. : 12/005306
DATED : November 11, 2008
INVENTOR(S) : Asaoka et al.

It is certified that error appears in the above-identified patent and that said Letters Patent is hereby corrected as shown below:

On the title page, item (30) should read:

(30) Foreign Application Priority Data

| | | |
|---|---|---|
| June 14, 2002 | (JP) | P2002-174037 |
| March 12, 2003 | (JP) | P2003-066163 |

Signed and Sealed this

Thirtieth Day of December, 2008

JON W. DUDAS
*Director of the United States Patent and Trademark Office*